US005313012A

United States Patent [19]

Ishida

[11] Patent Number: 5,313,012

[45] Date of Patent: May 17, 1994

[54] AUTOMATIC PERFORMANCE APPARATUS FOR MUSICAL INSTRUMENT WITH IMPROVED EDITING

[75] Inventor: Takashi Ishida, Hamamatsu, Japan

[73] Assignee: Yamaha Corporation, Hamamatsu, Japan

[21] Appl. No.: 888,260

[22] Filed: May 22, 1992

Related U.S. Application Data

[63] Continuation of Ser. No. 460,991, Jan. 4, 1990, abandoned.

[30] Foreign Application Priority Data

Jan. 6, 1989 [JP] Japan ..... 64-542
Jan. 6, 1989 [JP] Japan ..... 64-543
Jan. 6, 1989 [JP] Japan ..... 64-544

[51] Int. Cl.[5] ..... G10H 1/06; G10H 1/38; G10H 1/42

[52] U.S. Cl. ..... 84/609; 84/611; 84/613; 84/622; 84/DIG. 12; 84/DIG. 22

[58] Field of Search ..... 84/609-615, 84/622-625, 634-638, DIG. 12, DIG. 22

[56] References Cited

U.S. PATENT DOCUMENTS 4,768,413 9/1988 Fujimori ..... 84/609
4,953,438 9/1990 Shibukawa ..... 84/609
4,960,030 10/1990 Fujimori ..... 84/609
4,960,031 10/1990 Farrand ..... 84/609
5,085,116 2/1992 Nakata et al. ..... 84/609
5,113,744 5/1992 Tanaka et al. ..... 84/634

FOREIGN PATENT DOCUMENTS 58-63994 4/1983 Japan .
58-211191 8/1983 Japan .
60-12638 4/1985 Japan .

OTHER PUBLICATIONS

Ex parte S (Board of Appeals) Aug. 4, 1943 (Case No. 109), *Journal of the Patent Office Society.*

*Primary Examiner*—Stanley J. Witkowski
*Attorney, Agent, or Firm*—Graham & James

[57] ABSTRACT

An automatic performance apparatus for sequentially reading out performance data sequentially stored in a performance data memory to execute automatic performance, detects depression of a step forward key, and generates a tone for a predetermined time $T_3$ on the basis of performance data in the performance data memory designated by an address pointer. When the step forward key is depressed again within the predetermined Time $T_3$ from its first depression, the same performance data tone is continuously generated for the predetermined time $T_3$ from the second depression timing of the step forward key. When the step forward key is continuously depressed for a predetermined time $T_2$ or more from its first depression timing, the address pointer is stepped up upon each predetermined time $T_1$ to generate a performance data tone sequentially designated by the address pointer. According to this automatic performance apparatus, automatic performance data can be rapidly edited by simple manipulation.

11 Claims, 14 Drawing Sheets

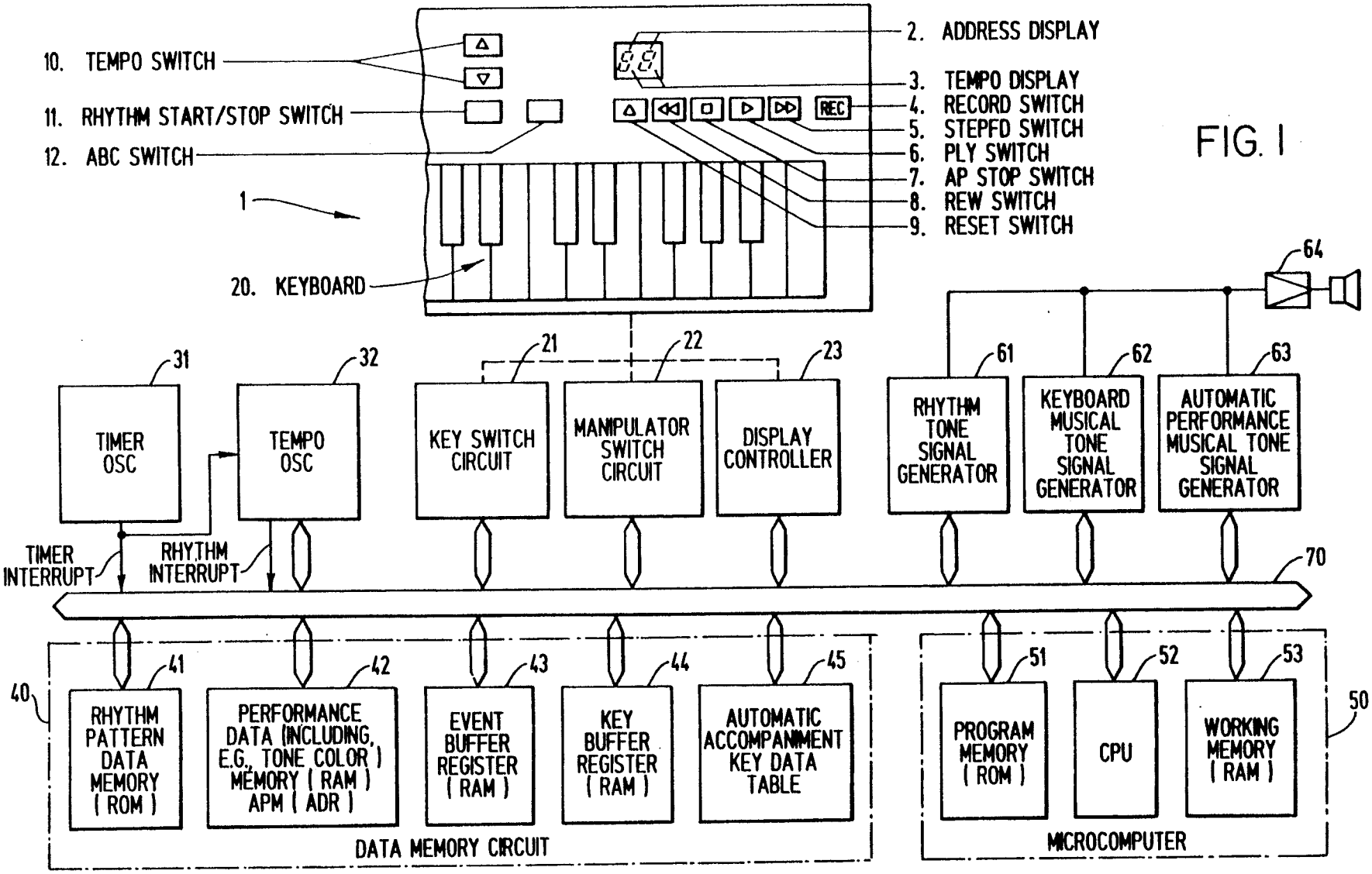
FIG. 1
2. ADDRESS DISPLAY
3. TEMPO DISPLAY
4. RECORD SWITCH
5. STEPFD SWITCH
6. PLY SWITCH
7. AP STOP SWITCH
8. REW SWITCH
9. RESET SWITCH
10. TEMPO SWITCH
11. RHYTHM START/STOP SWITCH
12. ABC SWITCH
1
20. KEYBOARD
REC
64
63
AUTOMATIC PERFORMANCE MUSICAL TONE SIGNAL GENERATOR
62
KEYBOARD MUSICAL TONE SIGNAL GENERATOR
61
RHYTHM TONE SIGNAL GENERATOR
70
50
53
WORKING MEMORY ( RAM )
52
CPU
51
PROGRAM MEMORY ( ROM )
MICROCOMPUTER
23
DISPLAY CONTROLLER
22
MANIPULATOR SWITCH CIRCUIT
21
KEY SWITCH CIRCUIT
45
AUTOMATIC ACCOMPANIMENT KEY DATA TABLE
44
KEY BUFFER REGISTER ( RAM )
43
EVENT BUFFER REGISTER ( RAM )
42
PERFORMANCE DATA (INCLUDING, E.G., TONE COLOR ) MEMORY ( RAM ) APM ( ADR )
41
RHYTHM PATTERN DATA MEMORY ( ROM )
DATA MEMORY CIRCUIT
32
TEMPO OSC
31
TIMER OSC
RHYTHM INTERRUPT
TIMER INTERRUPT
40

FROM FIG. 8B
S120
ABLE = 1 ?
NO
YES
S121
T ← T + 1
S122
T=T3 (1.3SEC)
NO
YES
S123
T ← 0
ABLE ← 0
S124
STOP TONE
S125
ADR ← ADR + 1
S126
REW = 1
NO
YES
S127
T=T4 (0.2SEC)
NO
YES
S128
ADR ← ADR - 1 T ← 0
CONVERT ADR INTO MEASURE NUMBER AND DISPLAY IT
S129
REPT = 1 ?
NO
YES
S130
T>1 AND IS "T-T2" MULTIPLE OF T1 ?
NO
2
YES
S131
REP T ← 0
T ← 0
ABLE ← 0
STOP TONE
TO FIG. 8B

AUTOMATIC PERFORMANCE APPARATUS FOR MUSICAL INSTRUMENT WITH IMPROVED EDITING

This is a continuation of application Ser. No. 07/460,991, filed on Jan. 4, 1990, now abandoned.

BACKGROUND OF THE INVENTION

1. Field of the Invention

The present invention relates to an automatic performance apparatus for sequentially reading out performance data sequentially stored in a performance data memory and executing an automatic performance.

2. Description of the Prior Art

Some conventional automatic performance apparatuses have a function of storing performance information input by a player in a memory unit and reproducing musical sounds from the performance information to execute an automatic performance.

An example of an automatic performance apparatus of this type is a so-called event recording/reproducing type automatic performance apparatus disclosed in, e.g., Japanese Patent Laid-Open (Kokai) No. Sho 58-211191 or Japanese Examined Patent Publication (Kokoku) No. Sho 60-12638. This apparatus stores performance data for an automatic performance as an "event" and reproduces musical sounds from the performance data upon automatic performance.

In such an automatic performance apparatus, a player sometimes desires to change a part of stored performance information. A conventional automatic performance apparatus, however, cannot edit performance information. That is, in the conventional automatic performance apparatus, stored performance information is read out simply at a key ON timing of a player, and a tone is generated in accordance with the readout performance information. An address pointer is then incremented (stepped up) to performance information for generating the next tone, and tones are generated in accordance with performance information sequentially designated by the address pointer. Therefore, it is difficult to set the address pointer at specific performance information to be edited in a plurality of pieces of performance information, i.e., it is difficult to edit performance information.

In addition, when automatic performance data is recorded by an event system, it is difficult to check a measure position in the performance data due to the event method. For example, in order to access data of an nth measure, data is sequentially read out from the first event data and a time is sequentially added assuming that a time period of one measure is T. When an addition time becomes $T \times n$, the corresponding position is recognized as the nth measure. Therefore, although the event method has a high data compression effect, this method is not suitable for editing, i.e., a case in which a part of stored performance data is to be changed.

Furthermore, in order to edit performance information in the above conventional apparatus, the address pointer is set at a position to be edited by various methods, and then a recording mode is set to record performance data. If, however, editing is executed for a position sustaining a tone, the sustained tone is continuously generated. As a result, desired performance data is not obtained after editing.

SUMMARY OF THE INVENTION

It is, therefore, an object of the present invention to allow rapid editing of performance information by simple manipulation in an automatic performance apparatus.

It is another object of the present invention to provide an automatic performance apparatus using performance data having a data format which enables rapid editing of performance information by simple manipulation.

It is still another object of the present invention to provide an automatic performance apparatus in which when performance information is edited, a sustained tone is prevented from being continuously generated to the edited portion.

According to the present invention, in an automatic performance apparatus having a performance data memory, depression of a step forward key (switch) is detected, and a performance data tone designated by an address pointer is generated for a predetermined time $T_3$.

The present invention includes an operation in which after this performance data tone is generated, the address pointer is incremented to an address of performance data for generating the next tone. The present invention also includes an operation in which if the step forward key is depressed again within the predetermined time $T_3$ after depression of the step forward key, the same performance data tone is retriggerably, continuously generated for the predetermined time $T_3$.

Furthermore, the present invention includes an operation in which when the step forward key is continuously depressed for a predetermined time $T_2$ or more from the depression timing of the step forward key, the address pointer is incremented upon each predetermined time $T_1$ to generate a performance data tone sequentially designated by the address pointer.

In this case, as described above, if the step forward key is depressed again within the predetermined time $T_1$, the same performance data tone is retriggerably, continuously generated for the predetermined time $T_3$ from the second depression timing of the step forward key.

With the above arrangement, when the step forward key is lightly depressed once, performance data is generated for the time $T_3$. If the step forward key is depressed again within the time $T_3$ from the first depression timing, the same performance data tone is continuously generated. If the step forward key is continuously depressed for the time $T_2$ or more, performance data is fast forwarded to generate a tone upon each time $T_1$. In this case, $T_2 < T_3$ is preferable to enable rapid processing.

The present invention includes an aspect in which a performance data memory includes a plurality of fixed-length records for an automatic performance, and each fixed-length record includes key data associated with touch tone generation (i.e., key data input by a player) and additional data for defining a tone generation characteristic having an effect on a plurality of successive key data. That is, key data having a large number of events within a unit time is continuously recorded in sequential fixed-length records, while additional data, e.g., tone-color data or style data is recorded over a plurality of records.

In this case, the fixed-length records are sequentially arranged to include, e.g., ¼-beat key data, and the additional data is stored over n continuous fixed-length records corresponding to one beat.

With the above arrangement, in order to access data of an nth measure upon performance data editing, the record length of the fixed-length records need only be multiplied by (n−1). Therefore, editing can be easily and rapidly executed. In addition, since the additional data such as tone-color data which is effective for a plurality of records are recorded over the plurality of records, data compression is achieved.

Moreover, the present invention includes an operation in which, in an automatic performance apparatus for sequentially reading out performance data sequentially recorded in a performance data memory to execute an automatic performance, in order to change performance data at a position designated by an address pointer, non-tone-generation key data is written immediately before the position designated by the address pointer.

With the above arrangement, upon editing of performance data, if a sustained tone exists immediately before the position to be edited, the non-tone-generation key data (key OFF data) is written to stop generation of the tone.

BRIEF DESCRIPTION OF THE DRAWINGS

FIG. 1 is a view showing an outer appearance of a keyboard section and the like of an automatic performance apparatus according to an embodiment of the present invention and a block diagram showing its internal arrangement;

FIGS. 9A to 9C are timing charts showing a step forward key depression timing, a tone generation state, and the like.

DETAILED DESCRIPTION OF THE PREFERRED EMBODIMENT

Figure 2A:
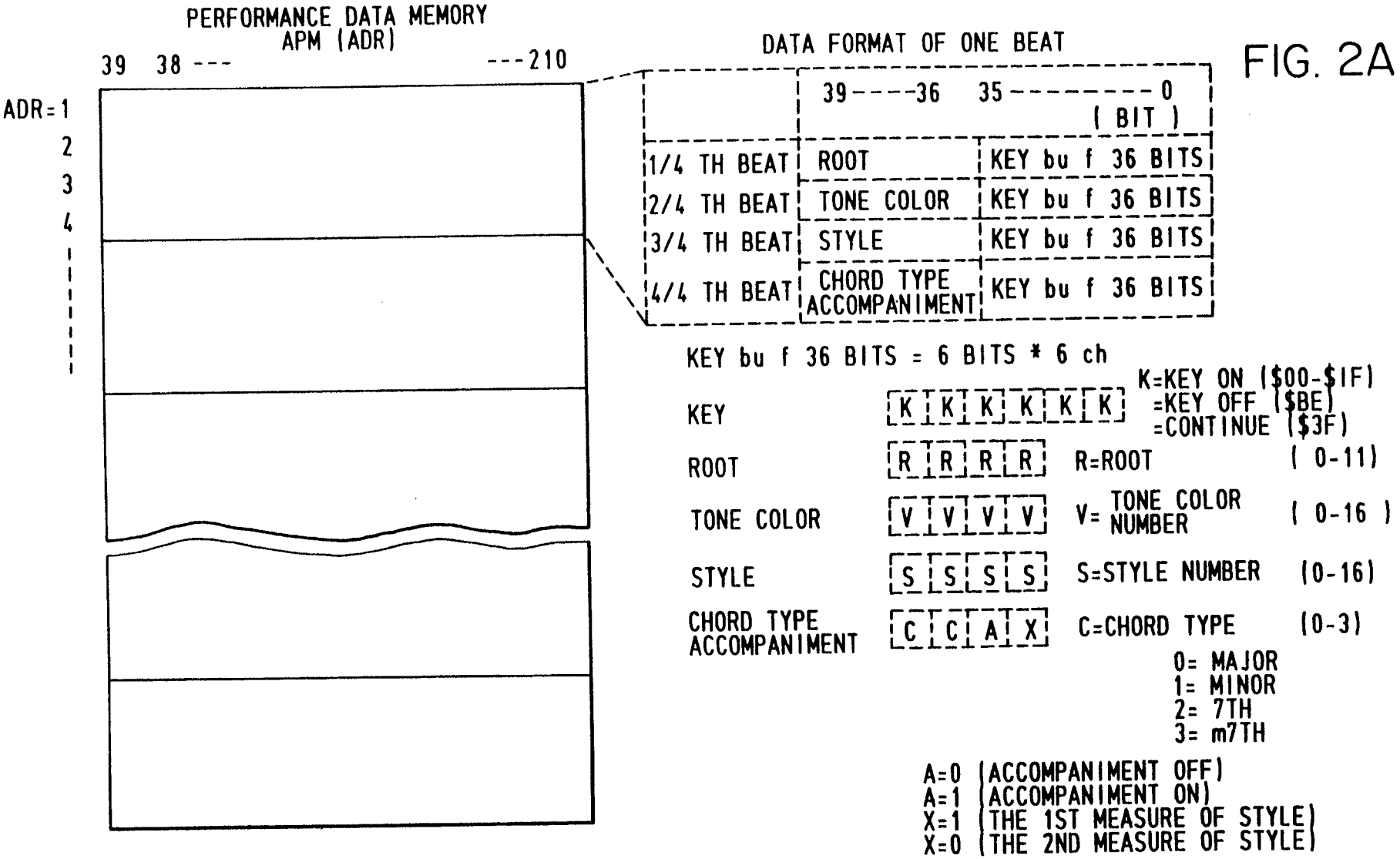
FIGS. 2A to 2C are views showing data formats.

An embodiment of the present invention will be described in detail below with reference to the accompanying drawings.

FIG. 1 is a view showing an outer appearance of a keyboard and the like of an automatic performance apparatus according to one embodiment of the present invention and a block diagram showing its internal arrangement. Referring to FIG. 1, reference numeral 1 denotes a part of a keyboard section. A panel unit of the keyboard section has various switches (keys). Reference numeral 2 denotes a 7-segment LED for address display; 3, a tempo display LED; 4, a REC switch for record-inputting an automatic performance tone; 5, a step forward (STEPFD) switch used to edit automatic performance data; 6, a PLY (play) switch for playing an automatic performance; 7, an AP (auto pattern) stop switch for stopping an automatic performance; 8, a REW (rewind) switch for rewinding an automatic performance in an opposite direction; 9, a RESET switch; 10, TEMPO switches for changing a tempo; 11, an auto rhythm start/stop switch; 12, an auto bass chord (ABC) switch; and 20, a performance keyboard.

Reference numeral 21 denotes a key switch circuit for detecting key depression and key release on the keyboard 20; 22, a manipulator switch circuit for detecting ON/OFF of the various manipulator switches 4–12 on the panel; 23, a display controller for the address display 2 and the tempo display 3; 31, a timer oscillator (OSC) for executing a timer interrupt upon each predetermined time interval; 32, a tempo OSC for generating a tempo reference signal; and 40, a data memory circuit comprising a rhythm pattern data memory (ROM) 41, an automatic performance data memory (RAM) 42, an event buffer register (RAM) 43, a key buffer register (RAM) 44, and an accompaniment key data table 45. These registers and memories will be described in detail later.

Reference numeral 50 denotes a microcomputer comprising a program memory (ROM) 51, a CPU 52, and a working memory 53; 61, a rhythm tone signal generator; 62, a keyboard musical tone signal generator; 63, an automatic performance musical tone signal generator; and 64, an amplifier. These circuits, microcomputer, and memories 21–63 are connected to a bus 70.

Various data formats will be described below with reference to FIGS. 2A to 2C.

FIG. 2A is a view showing a data format on the automatic performance data memory 42 shown in FIG. 1. Automatic performance data is stored in an arrangement APM 42, and performance data of each beat is a record having a fixed-length format accessed by the APM(ADR). A memory capacity is set to store automatic performance data of, e.g., 100 measures.

As shown in FIG. 2A, automatic performance data of one beat (quarter note) is stored by four elements of the arrangement APM. Assuming that one measure consists of four beats, the first performance data of a 20th measure is $4\times4\times(20-1)+1=305$th, i.e., APM(305). One element APM(ADR) represents automatic performance data of a ¼ beat. 0th to 35th bits (KEYbuf) of the data are key data, and its 36th to 39th bits are additional data. The key data is a 6-bit data KEY and represents one touch tone of a depressed key. One element (36 bits of the KEYbuf) of the key data can store data of six tones. As the additional data, ROOT (four bits) indicating the root of a chord, TCOLOR (four bits) indicating a tone color, STYLE indicating a style such as samba or tango, and CDTYPE.ACCOMP can be stored. The CDTYPE (two bits) is data representing the type of chord such as major or minor, the ACCOMP (one bit) is data representing ON/OFF of an accompaniment, and X is data representing the first or second measure of a style.

These additional data are set in units of beats as shown in FIG. 2A. That is, root data or a tone color stored in a data format of one beat (data from APM(ADR) to APM(ADR+3)) is effective to all key data during the one beat.

As described above, since automatic performance data is stored (in a so-called "continuous storage" manner) by fixed-length records for each beat, editing (punch IN and punch OUT) of the performance data can be very easily executed. In addition, since data such as key data having a large number of events within a unit time is stored continuously by fixed-length records while data such as tone color data having a small number of events is stored in one block (corresponding to one beat), data compression is achieved. Note that in the arrangement APM for storing automatic performance data, although APM(1) is used as the memory start, APM(0) may be similarly used as the start element.

Figure 2B:
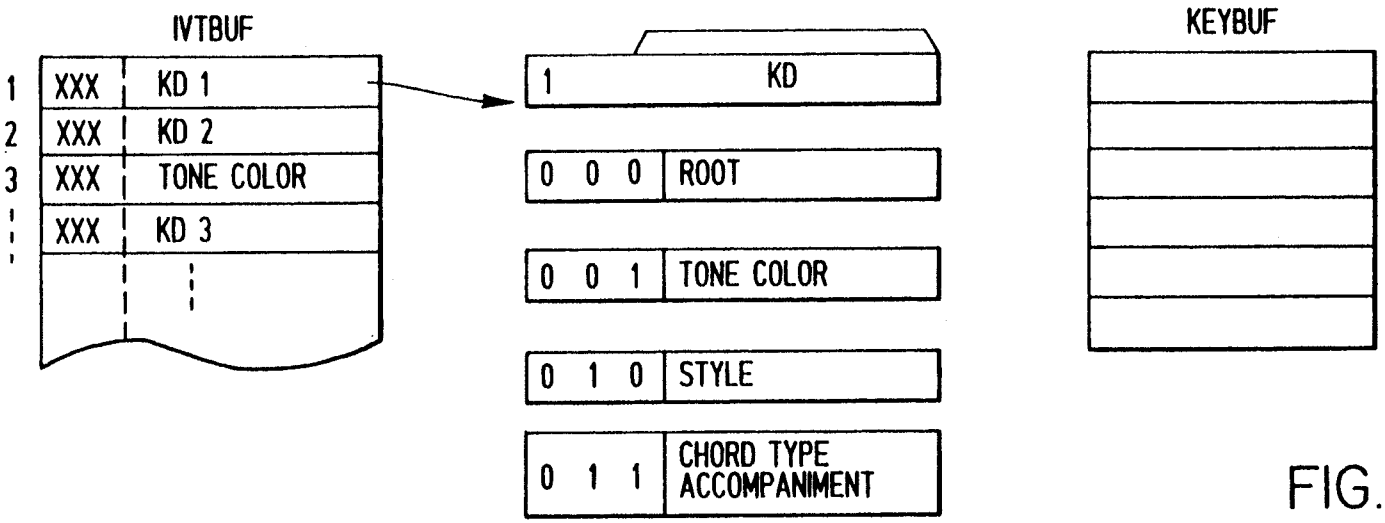

FIG. 2B shows a memory format of the event buffer register (IVTBUF) 43 shown in FIG. 1. When key depression or key release of keyboard keys is executed or the tone-color or style switch, for example, is depressed, the event buffer register IVTBUF 43 stores this event data. As shown in FIG. 2B, event data to be stored in the event buffer register IVTBUF 43 can be checked, on the basis of its first bit, whether it is key data concerning the keyboard (the first bit is "1") or additional data representing a root, a tone color, or the like (the first bit is "0"). If the event data is additional data, the type such as a root or tone color can be determined by the subsequent two bits. Data stored in the event buffer register IVTBUF 43 upon occurrence of an event is fetched by the key buffer register KEYBUF 44 and transferred to the musical signal generator 62, thereby generating a musical tone.

Figure 2C:
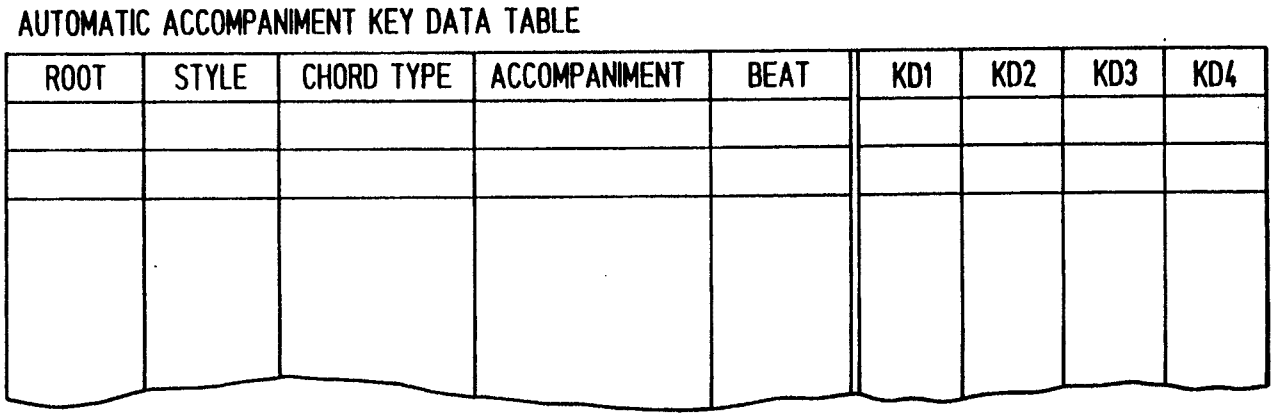

FIG. 2C shows a format of the automatic accompaniment key data table 45 shown in FIG. 1. When an automatic accompaniment is designated, the automatic accompaniment key data table 45 is used to determine key data (KD1 to KD4) for generating a tone in accordance with ROOT, STYLE, CDTYPE, ACCOMP, and BEAT (data indicating the beat number).

Other registers will be described below.

1. ADR: an address pointer used to designate automatic performance data stored in the automatic performance memory APM.
2. REC: a flag indicating a mode for recordinputting performance data in the performance data memory.
3. RECSY: a flag indicating a sync stand-by state in the performance data record-input mode.
4. PLY: a ply flag indicating an automatic performance reproduction mode for reading out performance data and generating a tone.
5. RUN: a run flag indicating a rhythm run state.
6. STEPFD: a step forward flag indicating depression of the step forward key 5.
7. REW: a flag indicating depression of the rewind key 8.
8. REPT: a flag indicating that a fast forward mode (repeat mode) for sequentially reading out performance data and generating a tone at an interval of $T_1$ sec is set by continuously depressing the step forward key 5.
9. ABLE: a flag indicating a retriggerable state.
10. T: a timer counter register.
11. $T_1$: a fixed value (in this case, 0.25 sec).
12. $T_2$ a fixed value (in this case, 0.7 sec).
13. $T_3$ a fixed value (in this case, 1.3 sec).
14. TCNT: a tempo counter register.

Note that for the sake of convenience in explanation, a storage area of each register or memory and its stored contents are represented by the same label name. For example, both the tempo counter register and its contents are represented by "TCNT".

An operation of the automatic performance apparatus shown in FIG. 1 will be described below with reference to flow charts shown in FIGS. 3 to 8.

Figure 3:
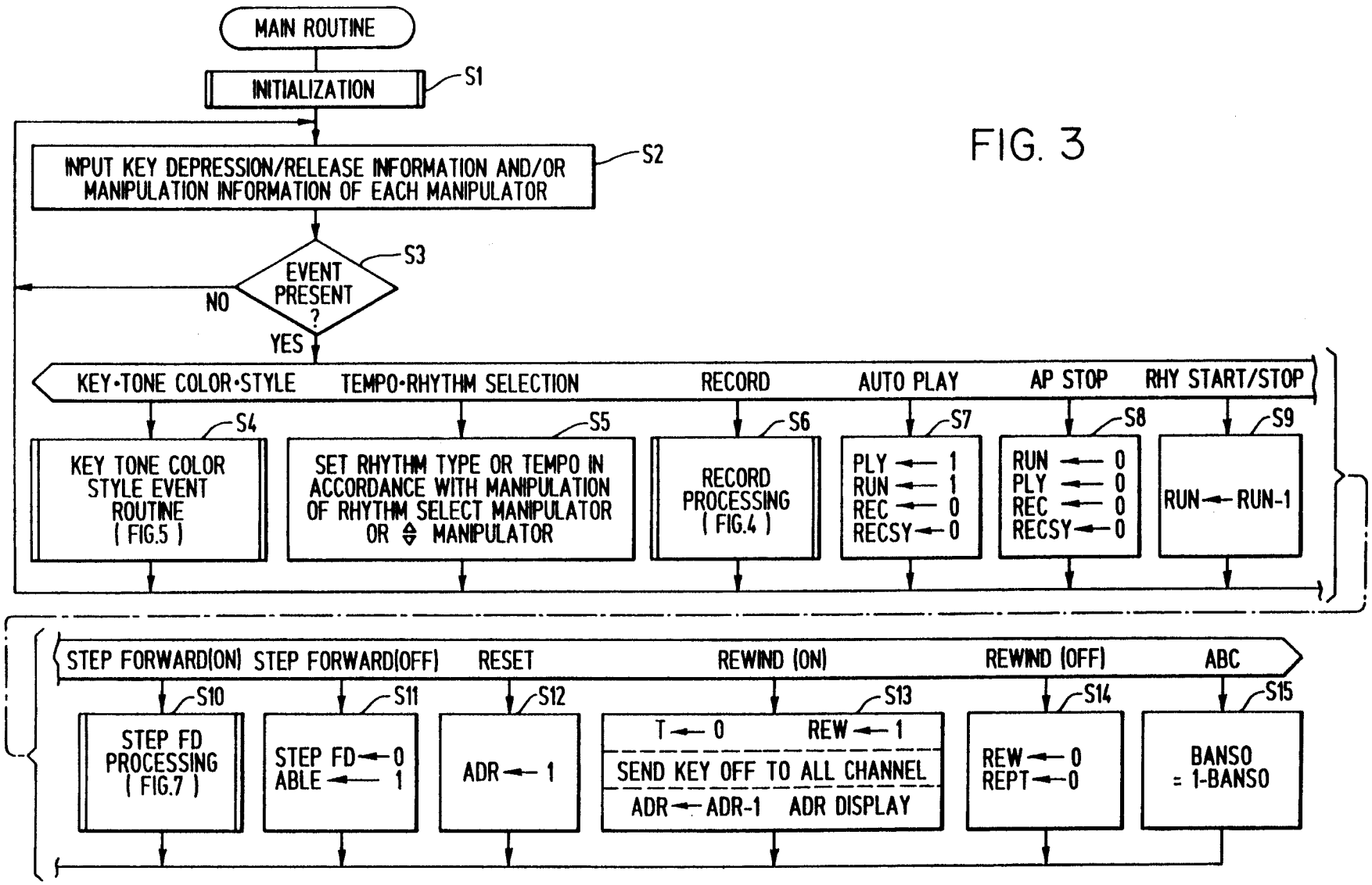
FIG. 3 is a main routine flow chart for explaining a main operation of the apparatus of the embodiment shown in FIG. 1.

Referring to a main routine shown in FIG. 3, when the automatic performance apparatus is switched on, initialization is executed in step S1, and key depression/-release information of the keyboard 20 and/or manipulation information of the manipulator switches (keys) 4 to 12 are input. If no event is detected in step S3, the flow returns to step S2. If an event is detected in step S3, the type of event is determined, and the flow branches to a corresponding one of processing routines (steps S4 to S15).

Figure 5A:
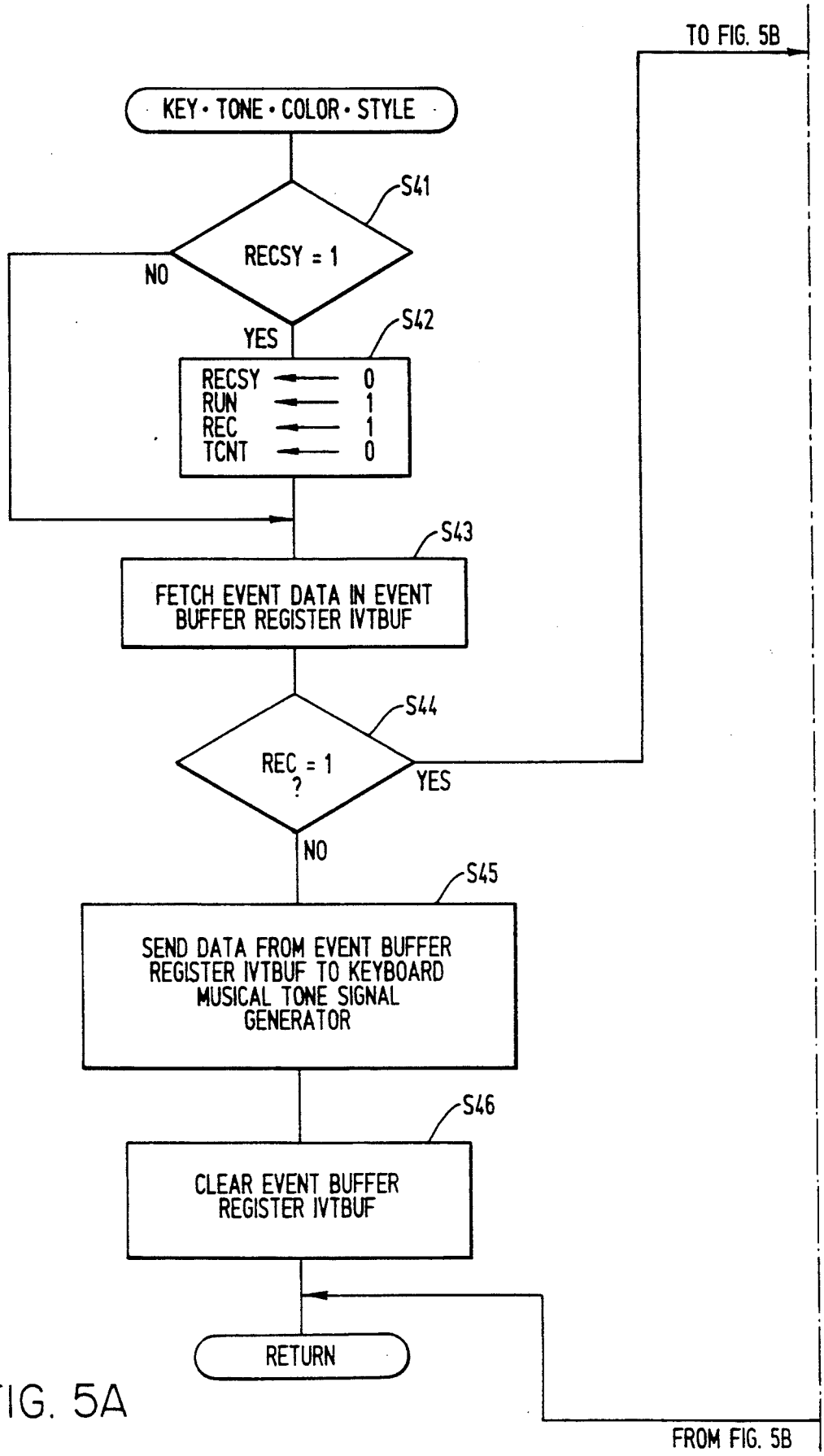
FIGS. 5A–C are flow charts for explaining an operation of processing executed upon depression of a keyboard or tone-color key.
Figure 5B:
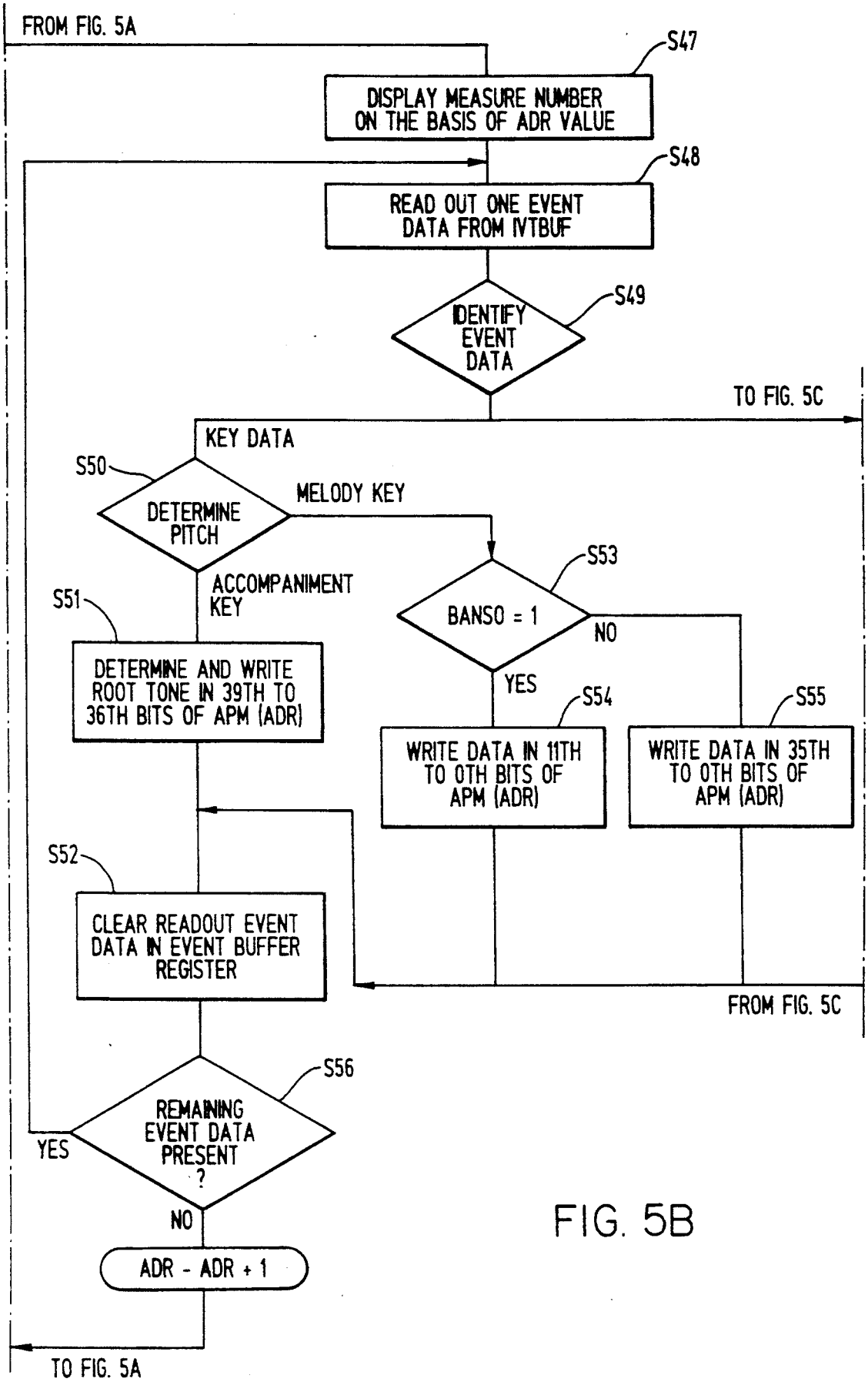
Figure 5C:
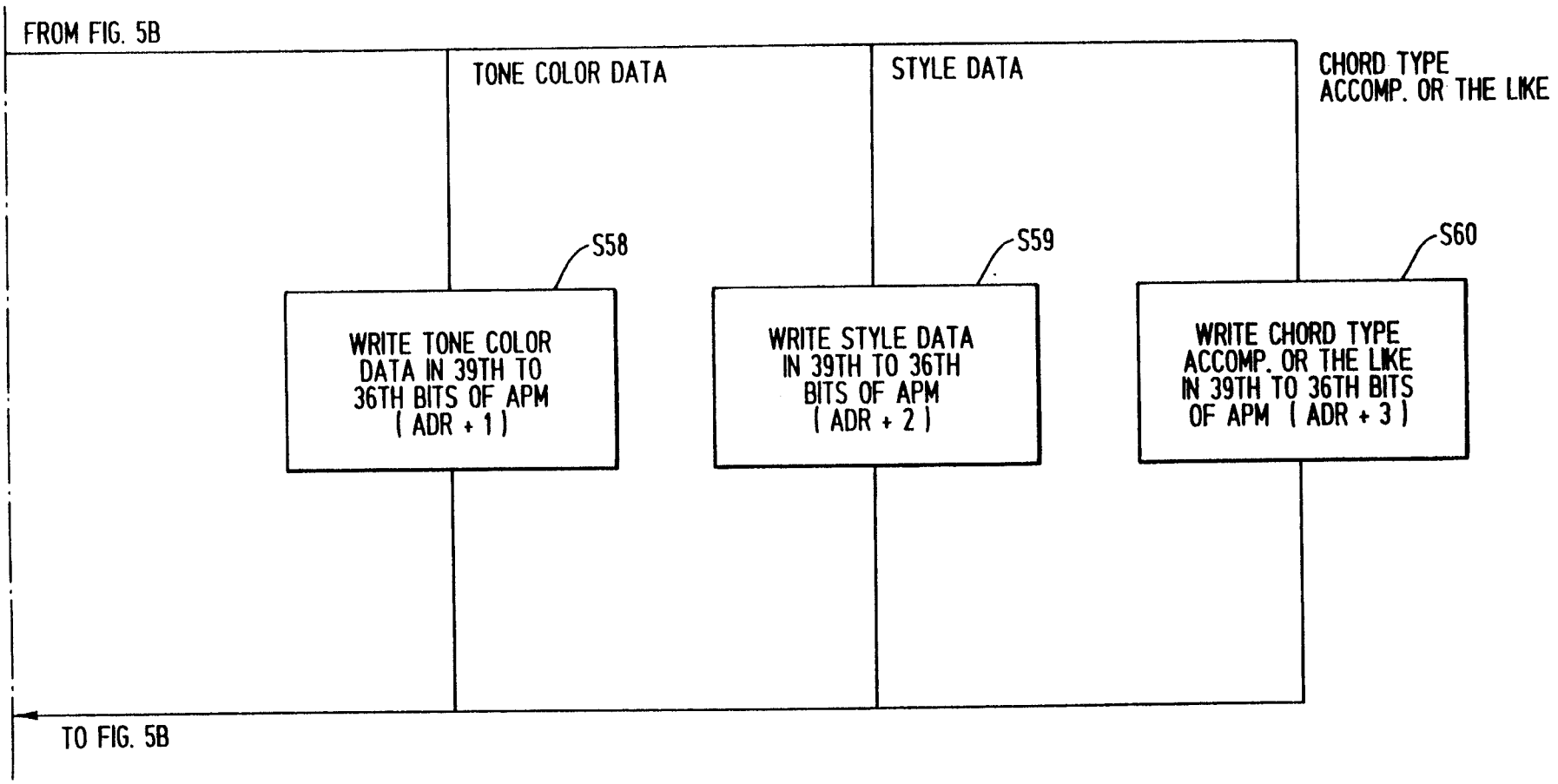

That is, if the event concerns a keyboard key, a tone color, or a style, the flow branches to step S4 to execute processing as shown in FIGS. 5A to 5C (to be described later).

If the event concerns tempo/rhythm selection, the flow branches to step S5 to set a rhythm type or a tempo in accordance with manipulation of a rhythm selecting manipulator (not shown) or the TEMPO manipulator switches (denoted by reference numeral 10 in FIG. 1).

Figure 4:
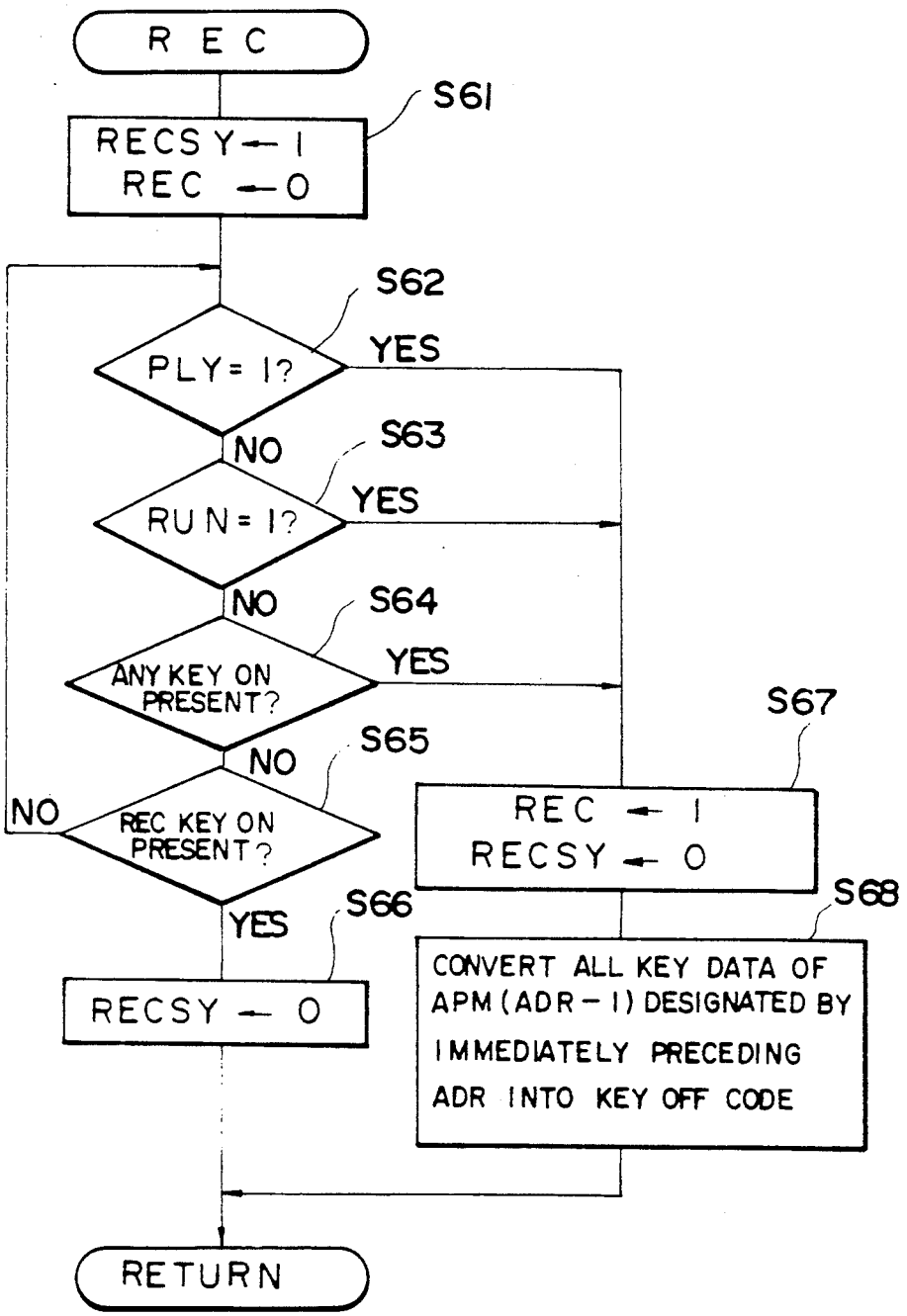
FIG. 4 is a flow chart for explaining an operation of performance data recording switch depression processing.

If the event concerns record-input of performance data such as depression of the REC switch 4, the flow branches to step S6 to execute processing as shown in FIG. 4 (to be described later).

If the event is depression of the PLY switch 6, the flow branches to step S7. In step S7, "1" is set in the play flag PLY to set an automatic performance reproduction mode, and "1" is set in the run flag RUN to set a rhythm run state. Upon setting of these flags, automatic performance data is reproduced and a rhythm tone is generated in accordance with a rhythm interrupt routine (FIGS. 6A and 6B) to be described later. In addition, in step S7, "0"s are set in the flags REC and RECSY to release the automatic performance record-input mode.

If the event is depression of the AP stop switch 7, the flow branches to step S8. In step S8, "0" is set in the play flag PLY to release the automatic performance reproduction mode, and "0" is set in the run flag RUN to release the rhythm run state. In addition, in step S8, "0"s are set in the flags REC and RECSY to release the automatic performance record-input mode.

If the event is depression of the rhythm start/stop switch 11, the flow branches to step S9 to invert the run flag RUN. That is, if the rhythm run state is currently being set, it is released. If the rhythm run state is currently not being set, the rhythm run state is set.

Figure 7:
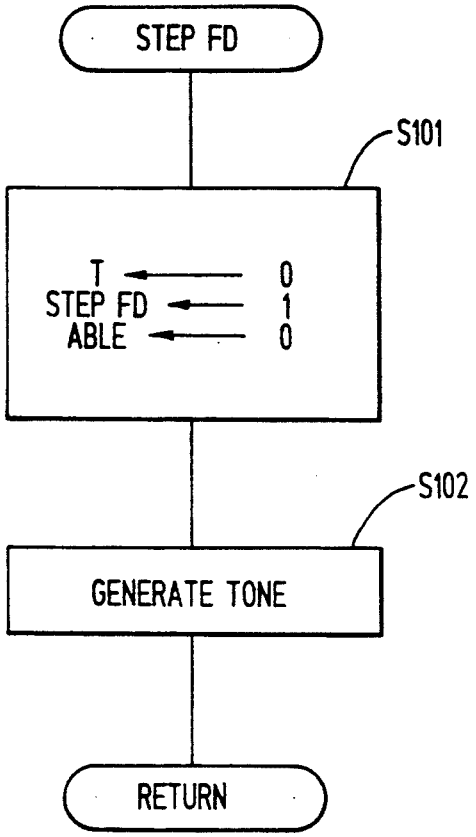
FIG. 7 is a flow chart for explaining an operation of step forward key depression operation.

If the event is an ON event of the step forward switch 5, the flow branches to step S10 to execute processing as shown in FIG. 7 (to be described later).

Figure 8A:
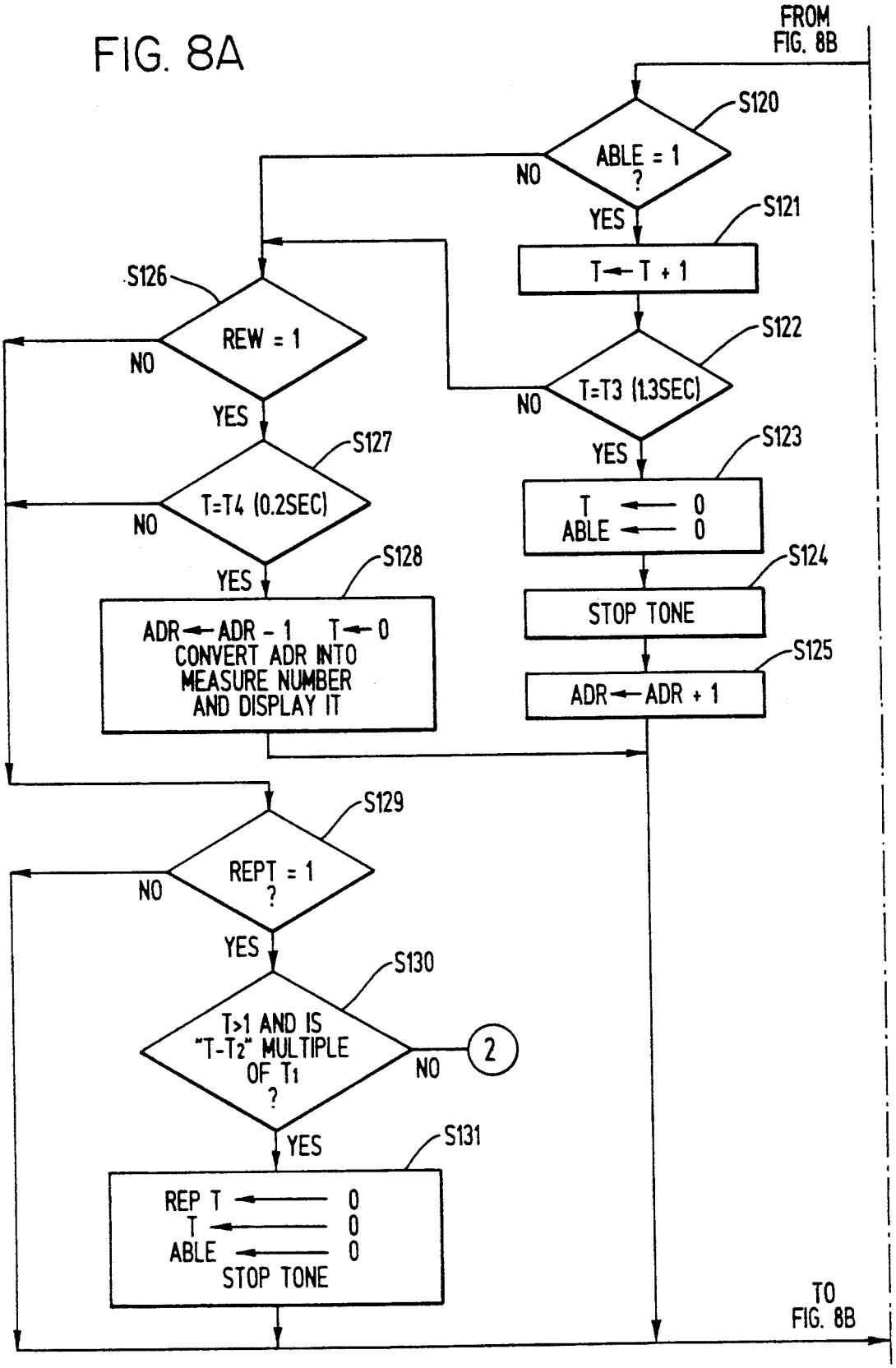
FIGS. 8A and 8B is a flow chart for explaining a timer interrupt operation.
Figure 8B:
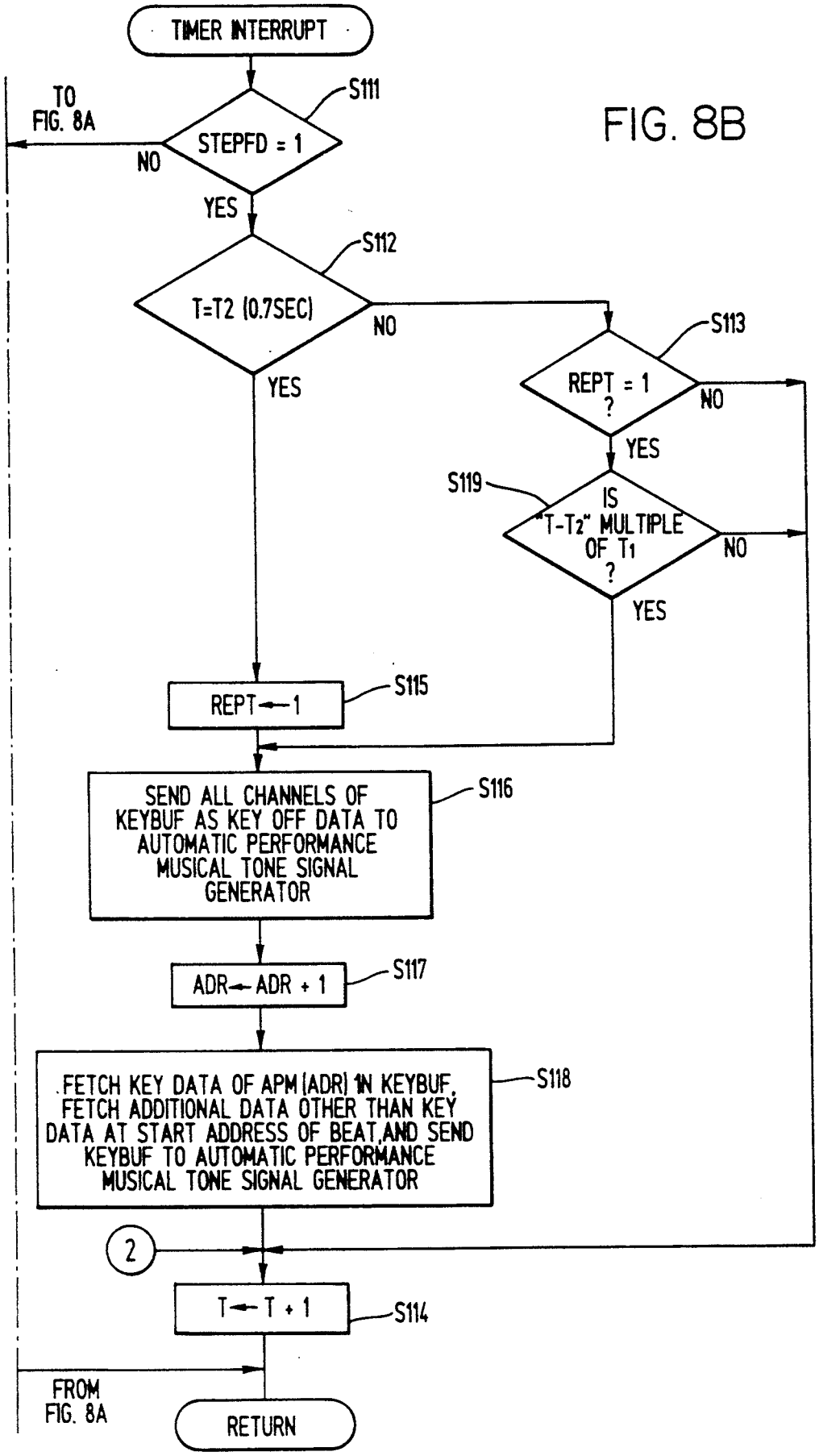

If the event is an OFF event of the step forward switch 5, the flow branches to step S11. In step S11, "0" is set in the flag STEPFD, and "1" is set in the flag ABLE. As a result, predetermined processing (to be described later) is executed in a timer interrupt routine (FIGS. 8A and 8B).

If the event is depression of the reset switch 9, the flow branches to step S12 to initialize the address pointer ADR to be "1".

If the event is an ON event of the rewind switch 8, the flow branches to step S13. In step S13, the timer register T is cleared to "0", and "1" is set in the rewind flag REW. As a result, predetermined rewind reproduction processing is executed in the timer interrupt routine (FIGS. 8A and 8B). Since a channel currently generating a tone must be stopped in order to further execute rewind, a key OFF signal is sent to all tone generation channels in step S13. The address pointer ADR is returned by "1", and this value is displayed on the address display 2.

If the event is an OFF event of the rewind switch 8, the flow branches to step S14 to set "0"s in the rewind flag REW and the repeat flag REPT. As a result, predetermined rewind OFF processing is executed in the timer interrupt routine (FIGS. 8A and 8B).

If the event is depression of the auto bass chord switch 12, the flow branches to step S15 to invert the automatic accompaniment flag BANSO. That is, if the auto bass run state is currently being set (if BANSO is "1"), it is released. If the auto bass run state is currently not being set (if BANSO is "0"), the auto bass run state is set.

After the event is determined in step S3 and predetermined processing is executed, the flow returns to step S2.

The REC processing in step S6 shown in FIG. 3 will be described with reference to FIG. 4. When the REC switch 4 is depressed, "1" and "0" are set in the flag RECSY and the flag REC, respectively, in step S61. As a result, a sync stand-by state is set. In steps S62, S63, and S64, whether the flag PLY is "1", the flag RUN is "1", and any key on the keyboard 20 is touched (depressed), are checked, respectively. If NO is determined in any of these steps, whether the REC key 4 is depressed is checked in step S65. If the REC key 4 is not depressed, the flow returns to step S62 to repeat this loop. If the REC key 4 is depressed again, the flag RECSY is cleared to "0" to release the sync stand-by state in step S66, and the flow returns to the main routine.

If the flag PLY is "1" in step S62 (if the REC key 4 is depressed in the automatic performance reproduction state), "1" is set in the flag REC and the flag RECSY is cleared to "0" in step S67. That is, a record-input mode for an automatic performance is set and the sync stand-by state is released. In step S68, all the key data in the performance data memory APM(ADR −1) designated by an immediately preceding address pointer ADR are converted into key OFF codes, and the flow returns to the main routine.

Step S68 is processing for editing automatic performance data. That is, upon so-called punch IN in which the reproduction state or the like transits to the recording state by depression of the REC key 4, previous key data (key code) sometimes continues while generating a tone. Therefore, key OFF is set in the performance data memory for all the key data to prevent them from continuously generating tones. As a result, tones are correctly generated in an automatic performance regardless of a position of already input automatic performance data from which punch IN is executed.

If the flag RUN is "1" in step S63 (if the REC key 4 is depressed in the auto rhythm run state), the flow similarly advances to step S67 to set the automatic performance record-input mode. If any key on the keyboard 20 is touched in step S64, the flow similarly advances to step S67.

By the above processinq shown in FIG. 4, in the automatic performance apparatus of this embodiment, the sync stand-by state (RECSY=1) is set upon depression of the REC switch 4 once, and the stand-by state is switched to the REC state upon depression of the PLY switch 6, the start/stop switch 11, or any keyboard key 20, or depression of the REC switch 4 again. A key code (key data) can be written immediately from this moment. In addition, if the REC switch 4 is depressed during a performance, punch IN can be executed from this position.

An operation executed when an event concerning a keyboard key, a tone color, a style, or the like is present (step S4 in FIG. 3) will be described below with reference to a flow chart shown in FIGS. 5A to 5C.

In step S41, whether the sync stand-by state is currently being set is checked. If YES in step S41, the flag RECSY and the register TCNT are cleared to "0", and "1"s are set in the flags RUN and REC in step S42. Event data is fetched to the event buffer register IVTBUF 43 in step S43, and whether the flag REC is "1" is checked in step S44. If the flag REC is not "1", it is determined that the performance data record-input mode is currently not being set. Therefore, in step S45, data in the event buffer register IVTBUF 43 is sent to the keyboard musical tone generator 62. This data includes a manipulation event of the panel switches 4–20. In step S46, the event buffer register IVTBUF 43 is cleared, and the flow returns to the main routine.

If the flag REC is "1" in step S44, the flow branches to step S47 since the event data must be recorded din the performance data memory 40. In step S47, the number of measures is displayed on the basis of the value of the address pointer ADR. One event data is read out from the event buffer register IVTBUF 43 in step S48 and is identified in step S49.

If the data is key data (key code), whether the key data represents an accompaniment key or a melody key is checked in accordance with its pitch in step S50. If the key data represents an accompaniment key, a root tone is determined and written in the 39th to 36th bits (ROOT) of the performance data memory APM(ADR) in step S51. If the key data represents a melody key in step S50, the flag BANSO is checked in steo S53. If the flag BANSO is "1" (i.e., if the flag indicates an automatic accompaniment), a touch key code is written in the 11th to 0th bits of the performance data memory APM(ADR) in step S54. That is, in order to perform the automatic accompaniment, touch key codes of two tones (6 bits×2) is recorded. If the flag BANSO is not "1" in step S53, a touch key code is written in the 35th to 0th bits of the performance data memory APM(ADR) in step S55. When the automatic accompaniment is not to be performed, touch key codes of six tones (6 bits×6) is recorded.

If the event data is tone color data in step S49, the tone color data is written in the 39th to 36th bits (TCOLOR) of the performance data memory APM(ADR+1) in step S58. If the event data is style data, the style data is written in the 39th to 36th bits (STYLE) of the performance data memory APM(ADR+2) in step S59. If the event data is chord type data or accompaniment ON/OFF data, the data is written in the 39th to 36th bits (CDTYPE.ACCOMP) of the performance data memory APM(ADR+3) in step S60.

In step S52, the readout event data in the event buffer register IVTBUF 43 is cleared. In step S56, whether remaining event data is present is checked. If any remaining event data is present, the flow returns to step S48 to repeat the above processing. If no remaining event data is present, the address pointer ADR is stepped up in step S57, and the flow returns to the main routine.

By the above processing, automatic performance data record-input is executed to store each event in the performance data memory APM. Note that in this embodiment, the registers T and ADR are stepped up at a predetermined interval by the timer interrupt routine in a performance data record-input mode (not shown).

Data (no-tone data) from a key OFF event to a key ON event is also recorded in the APM. In addition, a tone color change during a beat is written in the next beat.

Figure 6A:
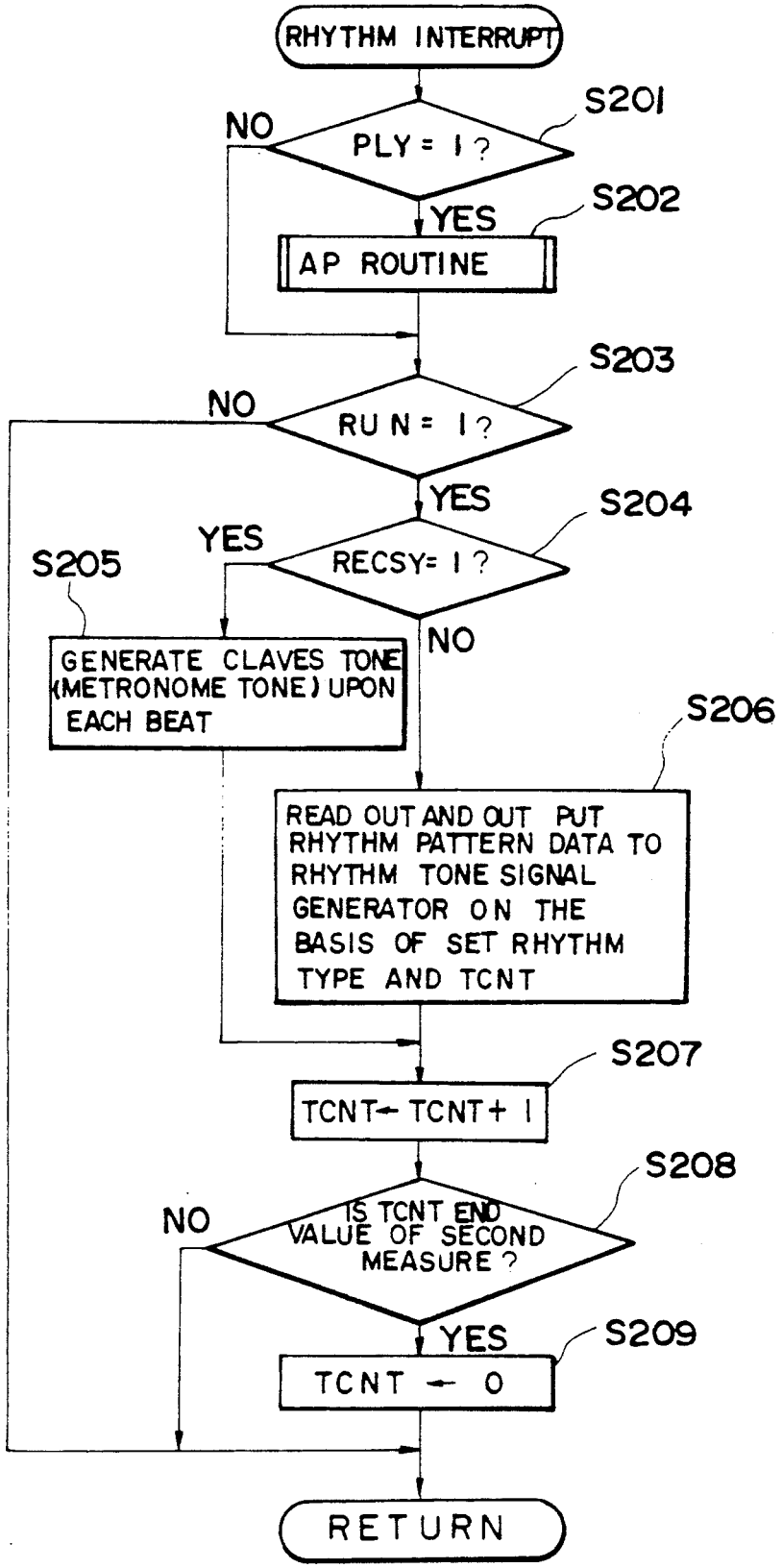
FIGS. 6A and 6B are flow charts for explaining an operation of processing rhythm interrupt and an automatic performance routine.
Figure 6B:
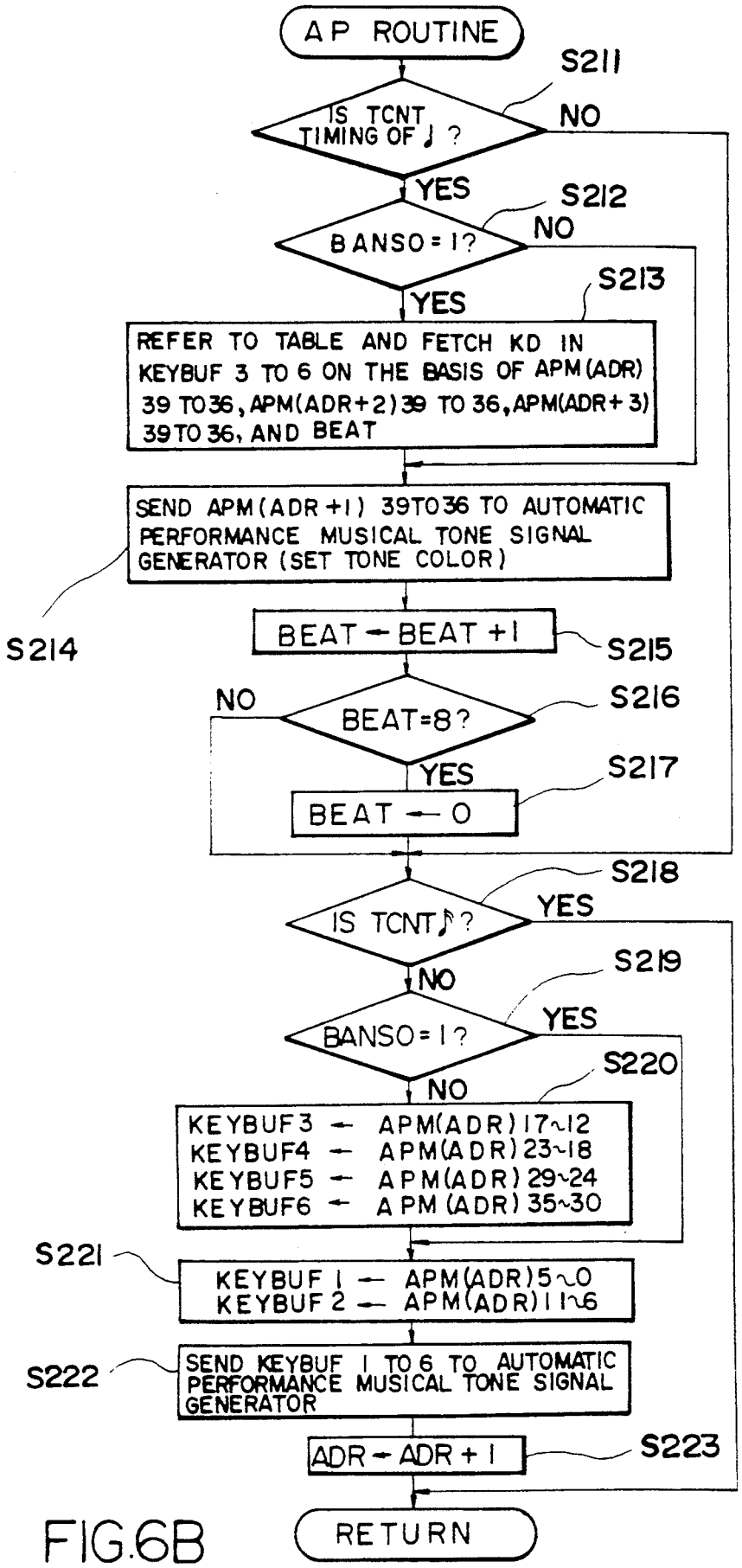

Rhythm interrupt processing will be described below with reference to flow charts shown in FIG. 6A and 6B. The rhythm interrupt is interrupt processing executed upon each predetermined time interval which is $\frac{1}{3}$ of a sixteenth note corresponding to the resolution ($\frac{1}{4}$ of a quarter note) of the automatic performance memory APM.

In step S201, whether an automatic performance is currently being reproduced is checked in accordance with the flag PLY. If the automatic performance is being reproduced, an AP routine in FIG. 6B is called, and the flow advances to step S203. If an automatic performance is not being reproduced, the flow directly advances to step S203. In step S203, the run flag RUN is checked. If the rhythm run state is not determined, the flow returns. If the rhythm run state is determined, whether the sync stand-by state is set is checked in step S204. If the sync stand-by state is determined, a claves tone (metronome tone) is generated upon each beat in step S205. If the sync stand-by state is not set, rhythm pattern data is read out and output to the rhythm tone signal generator 61 on the basis of the set rhythm type and the tempo counter TCNT in step S206. Thereafter, the tempo counter TCNT is stepped up in step S207, and whether the TCNT indicates the end position of the second measure is checked in step S208. If the TCNT indicates the end of the second measure, the TCNT is cleared to "0" in step S209, and the flow returns.

The AP routine shown in FIG. 6A will be described below with reference to FIG. 6B. In step S211, whether the tempo counter TCNT indicates the start timing of a quarter note is checked. If NO in step S211, the flow advances to step S218. If the tempo counter TCNT indicates the start timing of a quarter note, whether an automatic accompaniment is designated is checked in step S212. If YES in step S212, in step S213, the automatic accompaniment key data table 45 (FIG. 1 and FIG. 2C) is referred to fetch corresponding key data in the key buffer register KEYBUF 44 channels 3 to 6 on the basis of ROOT, STYLE, and CDTYPE ACCOMP ( APM(ADR) 39th to 36th bits, APM(ADR +2) 39th to 36th bits, and APM(ADR+3) 39th to 36th bits) of the automatic performance data memory APM. This is the data for generating a tone for an automatic accompaniment. In step S214, tone color data (APM(ADR +1) 39th to 36th bits) is sent to the automatic performance musical tone signal generator 63 to set a tone color. The register BEAT is stepped up in step S215, and whether BEAT is "8", i.e., whether the second measure is reached is checked in steo S216. If BEAT is "8", BEAT is cleared to "0" in step S217.

In step S218, whether the tempo counter TCNT indicates the start timing of a sixteenth note is checked. If NO in step S218, the flow directly returns. If the start timing of a sixteenth note is determined, whether an automatic accompaniment is currently being executed is checked on the basis of the flag BANSO in steo S219. If an automatic accompaniment is not being executed, four tones of key codes of the 12th to 35th bits of the performance data APM(ADR) are set in the key buffer register KEYBUF 44 channels 3 to 6 in step S220. In step S221, two tones of key codes of 0th to 11th bits of the performance data APM(ADR) are set in the key buffer register KEYBUF 44 channels 1 and 2. In step S222, the key buffer register KEYBUF 44 channels 1 to 6 are sent to the automatic performance musical tone signal generator 63 to generate tones. In step S223, the address pointer ADR is stepped up, and the flow returns.

Depression of the step forward key 5 and corresponding tone generation processing will be described below with reference to flow charts shown in FIGS. 7 and 8.

When the step forward key STEPFD 5 is depressed, a step forward routine STEPFD shown in FIG. 7 is called from step S10 shown in FIG. 3.

Referring to FIG. 7, in step S101, the timer counter T is initialized to be "0", "1" is set in the flag STEPFD indicating depression of the step forward key 5, and the flag ABLE is cleared to "0". In step S102, performance data designated by the current address pointer ADR is used to generate a tone as in step S118 of FIGS. 8A and 8B (to be described later), and the flow returns to the main routine.

Thereafter, if a timer interrupt is generated, processing shown in FIGS. 8A and 8B is executed. In step S111, the flag STEPFD is checked. If "1" is set in the flag STEPFD upon depression of the steo forward key 5, the flow advances to step S112 to check whether a time T from the depression timing of the step forward key 5 is $T_2=0.7$ sec. If NO in step S112, whether the flag REPT is 37 1" is checked in step S113. The flag REPT is set when the step forward key 5 is continuously depressed for $T_2=0.7$ sec. If the flag REPT is not "1" in step S113, the flow branches to step S114 to step up the timer count T and then returns.

If the flag REPT is "1" in step S113 (i.e., if the step forward key 5 is continuously depressed for the time $T_2$ or more), whether $T-T_2$ is a multiple of a predetermined time $T_1=0.25$ sec is checked in step S119. If NO in step S119, the flow branches to step S114. If YES in step S119, the flow advances to step S116. In step S116, all the channels of the key buffer register KEYBUF 44 are sent as key OFF data to the automatic performance musical tone signal generator 63 to stop generation of the tone. In step S117, the address pointer ADR is stepped up. In step S118, key data of the performance data APM(ADR) is fetched in the register KEYBUF 44 and sent to the automatic performance musical tone signal generator 63 to generate a tone. Note that at the start address of a beat, additional data other than key data is also fetched in the register KEYBUF 44 and sent to the musical tone signal generator 63 to set a tone color and the like. Thereafter, the flow advances to step S114.

If the flag STEPFD is not "1" in step S111 (i.e., if the step forward key 5 is OFF), the flag ABLE is checked in step S120. "1" is set in the flag ABLE in step S11 of FIG. 3 when the step forward key 5 is switched off, and a performance data tone designated by the current address pointer ADR is continuously generated while "1" is set in the flag ABLE. If the flag ABLE is "1" in step S120, the timer count T is stepped up in step S121, and whether the timer count T is equal to $T_3=1.3$ sec is checked in step S122. If the timer count T is equal to the time $T_3$, the timer count T is cleared to "0" and the flag ABLE is reset to "0" in step S123. A tone currently being generated is stooped in step S124, the address pointer ADR is stepped up in step S125, and the flow returns.

If the flag ABLE is not "1" in step S120, or if the timer count T is not equal to $T_3=1.3$ sec in step S122, the flow branches to step S126 to check the flag REW. If the flag REW is "1", whether the timer count T is equal to a predetermined time $T_4=0.2$ sec is checked in step S127. If YES in step S127, the flow advances to step S128. In step S128, the address pointer ADR is decremented by "1" and displayed, the timer count T is cleared to "0", and the flow returns.

If the flag REW is not "1" in step S126, or if the timer count T is not equal to the time $T_4=0.2$ sec in step S127, whether the flag REPT is "1" is checked in step S129. If the flag REPT is "1", the flow advances to step S130. If the flag REPT is not "1", the flow returns. In step S130, whether the timer count T exceeds one second and $T-T_2$ is a multiple of $T_1=0.25$ sec is checked. If YES in step S130, the flag REPT, the timer count T, and the flag ABLE are cleared to "0" to stop the tone, and the flow returns. If NO in step S130, the flow branches to step S114 to execute the above processing.

Figure 9A:
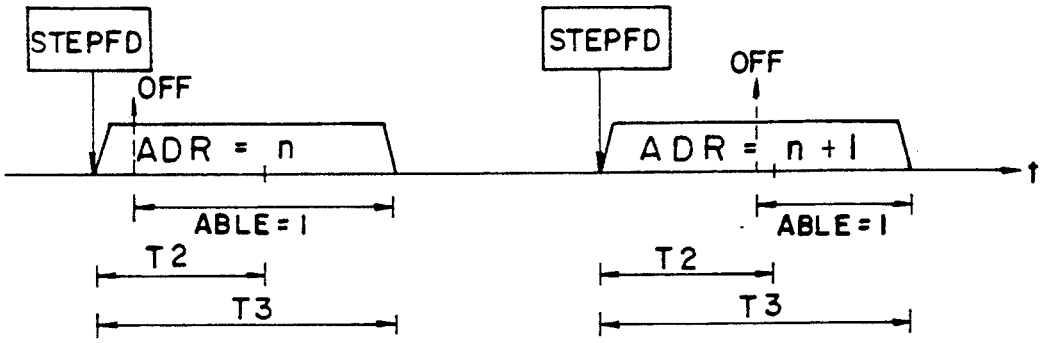
Figure 9B:
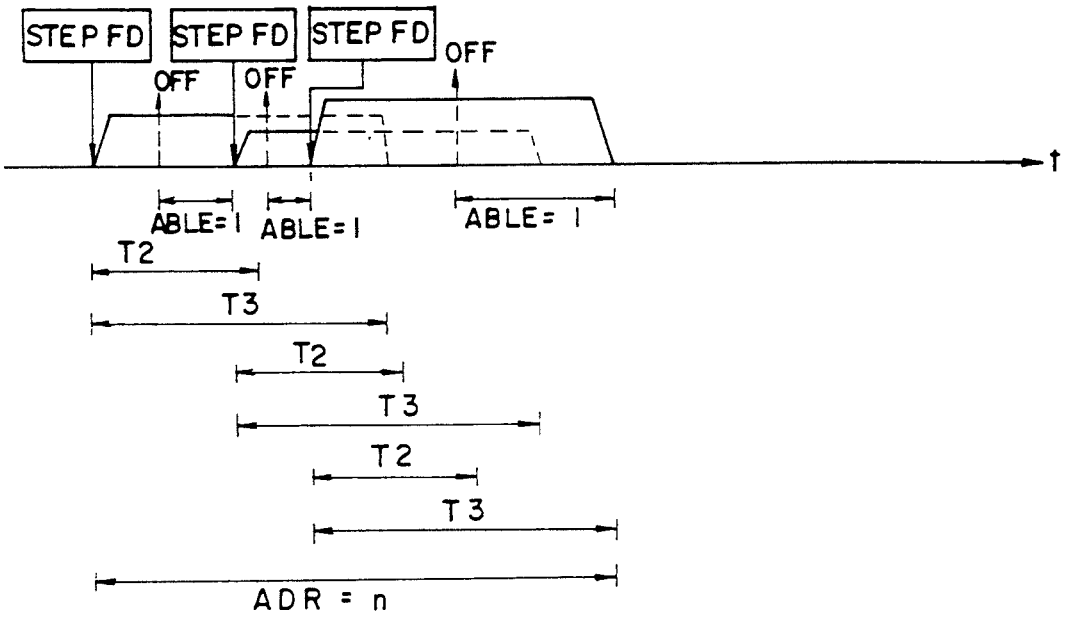
Figure 9C:
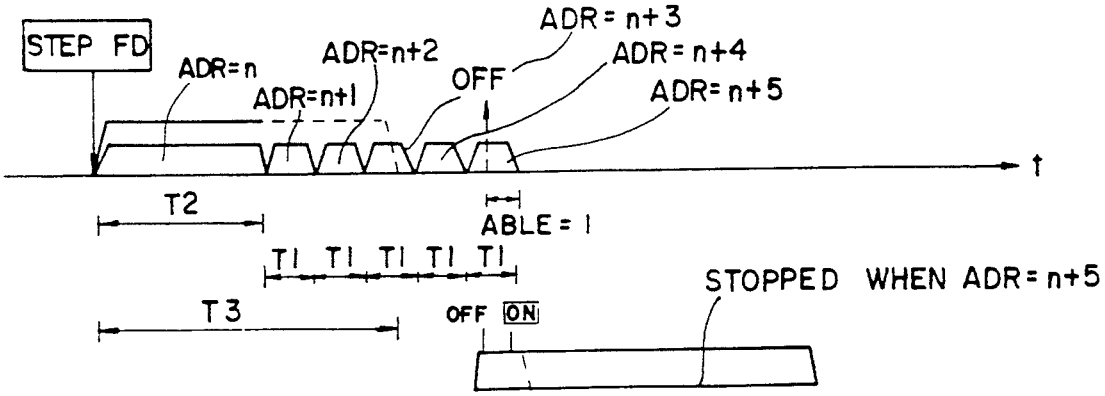

FIGS. 9A to 9C are timing charts showing depression timings of the step forward key 5, a tone generation state, and the like.

Referring to FIG. 9A, the step forward key STEPFD 5 is switched off (depression is stopped) within a predetermined time $T_2=0.7$ sec after it is depressed. At this time, if the current address pointer ADR is n, a tone is generated on the basis of performance data designated by this ADR=n for a predetermined time $T_3=1.3$ sec, and the address pointer ADR is stepped up to be n+1. Thereafter, if the step forward key STEPFD 5 is similarly depressed, a tone is similarly generated for $T_3=1.3$ sec.

An internal processing sequence for executing the above operation shown in FIG. 9A is as follows. That is, when the step forward key STEPFD 5 is depressed, the STEPFD processing shown in FIG. 7 is called by step S10 of the main routine in FIG. 3, and automatic performance data designated by the current address pointer ADR is read out to start tone generation (step S102 in FIG. 7). Thereafter, the processing shown in FIG. 8 is executed by a timer interrupt. In this case, immediately after the step forward key 5 is depressed, the sequence repeats a loop of step S111→step S112→step S113→step S114→return, thereby continuously generating a tone. If the step forward key 5 is switched off before the time $T_2$ sec elapses after depression, predetermined flags are changed in step S11 of the main routine shown in FIG. 3. In the subsequent timer interrupt, the sequence repeats a loop of step S111→Step S120→Step S121→step S122→step S126→step S129→return, thereby continuously generating the tone. When the time $T_3$ elapses, the sequence repeats a loop of step S111 step S120→step S121→Step S122→step S123→step S124→step S125 return, thereby stopping the tone. At this time, the address pointer ADR is stepped up by step S125. Therefore, if similar manipulation is executed, a tone is generated or stopped on the basis of performance data designated by ADR=n+1.

An operation shown in FIG. 9B, i.e. . . . , an operation in which the step forward key STEPFD 5 is depressed again within $T_3$ sec after its first depression will be described below.

This operation is executed in the same manner as that shown in FIG. 9A from a timing at which the step forward key 5 is depressed for the first time and a tone is generated on the basis of performance data designated by the current address pointer ADR=n to a timing at which the step forward key 5 is switched off to continuously generate the tone. In the operation shown in FIG. 9B, however, the step forward key 5 is depressed again before $T_3$ sec elapses after its first depression. In this case, the STEPFD processing shown in FIG. 7 is executed. In addition, the timer interrupt sequence repeats a loop of step S111→step S112→step S113→step S114→return, thereby continuously generating the tone. If the step forward key 5 is depressed again within $T_3$ sec after its second depression, the tone is similarly continuously generated. By repeating this sequence, the tone is continuously generated on the basis of performance data designated by the same address pointer ADR=n.

An operation shown in FIG. 9C, i.e., an operation in which the step forward key STEPFD 5 is continuously depressed for $T_2$ sec or more will be described below.

This operation is executed in the same manner as that in FIG. 9A from a timing at which the step forward key 5 is depressed first to a timing at which a tone is generated on the basis of performance data designated by the current address pointer ADR=n. When $T_2$ elapses after the step forward key 5 is depressed, however, the timer interrupt routine processes a loop of step S111→step S112→step S115→step S116→step S117→step S118→S114→return, thereby generating a tone on the basis of performance data designated by ADR=n+1. Thereafter, a loop of step S111→step S112→step S113→step S119→step S114→return is repeated to continuously generate a tone. When $T-T_2$ becomes a multiple of $T_1$, a loop of step S111→step S112→step S113→step S119→step S116→step S117→step S118→step S114→return is processed, thereby generating a tone on the basis of performance data designated by ADR=n+2. Similarly, if the step forward key 5 is continuously depressed (i.e., kept depressed), the address ADR is stepped up upon each $T_1=0.25$ sec, thereby sequentially generating a tone. When the step forward key 5 is switched off, a tone is continuously generated by a loop of step S111→step S120→step S121→step S122→ step S126→step S129→step S130→step S114→return. Thereafter, the tone is stopped by a loop of step S111 →step S120→step S121→step S122→step S126→step S129→step S130→step S131→return.

If the step forward key 5 is switched off and then depressed again during $T_1$ (i.e., if ADR=n+5 in FIG. 9C), ADR=n+5 is held to generate a tone for $T_3$ sec.

According to this embodiment, if a user simply desires to listen to a tone designated by the current address pointer ADR, he or she can generate the tone for $T_3=1.3$ sec by lightly depressing the step forward key, as shown in FIG. 9A. If a user desires to listen to the tone longer, he or she can continuously listen to the same performance data tone by depressing the step forward key again within $T_3=1.3$ sec. This is effective when data is chord data or the like and a user desires to check which tone is generated to overlap another.

If a user desires to fast forward data, he or she need only continuously depress the step forward key for $T_2$ sec which is shorter than $T_3$. As a result, the repeat mode is set to fast forward performance data, thereby rapidly starting a fast forward operation.

In this embodiment, the address pointer is stepped up after tone generation. The address pointer ADR, however, may be stepped up when the step forward key is kept depressed to repeat processing as shown in FIG. 9C.

In addition, it is a matter of course that data of one beat may be read out to step up the address by one beat upon one ON operation of the step forward key (switch).

As has been described above, according to the present invention, the automatic performance apparatus includes a function of generating a tone for a predetermined time $T_3$ sec on the basis of performance data designated by the address pointer, a function of continuously generating the same data tone, and a function of fast forwarding tone generation. Therefore, automatic performance data can be rapidly edited by simple manipulation.

In addition, in the automatic performance apparatus, the key data is continuously stored in a fixed-length record. Therefore, editing (so-called punch IN and punch OUT) of automatic performance data can be rapidly performed by simple manipulation. Since additional data other than key data (key code) such as tone color data effective for key data over a plurality of records is stored over a plurality of records, data compression can be effectively achieved.

Furthermore, in the automatic performance apparatus, in order to edit performance data, non-tone-generation key data is written immediately before the position of the performance data. Therefore, the performance data can be correctly edited regardless of a position of editing (so-called punch IN) for the automatic performance data, thereby preventing a tone from being kept generated.

What is claimed is:

1. An automatic performance apparatus for sequentially reading out performance data sequentially stored in a performance data memory to execute an automatic performance, comprising:

a step forward key;

an address pointer for designating an address of current performance data to be used to generate a tone in said performance data memory;

detecting means for detecting depression and release of the step forward key and for causing the address pointer to step from the address of the current performance data to an address of a next performance data in response to the detection of depression and release of the step forward key within a first predetermined time interval; and tone generating means for generating a performance data tone designated by said address pointer when depression of said step forward key is detected and continuing generation of said tone for a predetermined time interval which is longer than the first interval when release of the step forward key is detected within the first predetermined time interval.

2. An apparatus according to claim 1, further comprising means for, when said step forward key is depressed again within the second predetermined interval time after the first depression thereof, retriggerably, continuously generating the same performance data tone for the second predetermined time interval from the second depression timing of said step forward key.

3. An automatic performance apparatus for sequentially reading out performance data sequentially stored in a performance data memory to execute an automatic performance, comprising:

a step forward key;

detecting means for detecting a depression of the step forward key;

an address pointer for designating performance data to be used to generate a tone in said performance data memory;

tone generating means for generating a performance data tone designated by said address pointer when depression of said step forward key is detected; and means for, when said step forward key is continuously depressed for not less than a first predetermined time from the initial depression timing of said step forward key, sequentially stepping said address pointer upon the passage of each of second predetermined time intervals to generate performance data tones corresponding to addresses sequentially designated by said address pointer.

4. An apparatus according to claim 3, further comprising means for, when said step forward key is released and depressed again within the second predetermined time interval from the first depression, retriggerably, continuously generating the same performance data tone for a third predetermined time interval from the second depression timing of said step forward key.

5. An apparatus according to claim 4, wherein the predetermined time intervals satisfy the following relation:

second interval < first interval < third interval.

6. An automatic performance apparatus comprising:

a performance data memory for sequentially storing a performance data to execute an automatic performance;

control means for producing the performance data for storage in the memory with a storage format including a plurality of fixed-length records, each of the fixed-length records including key data concerning tone generation and a portion of additional data for defining a tone generation characteristic for a plurality of successive key data;

reading means for sequentially reading out said performance data from said performance data memory; and tone signal generation means for generating musical tones have tone characteristics in accordance with the performance data.

7. An apparatus according to claim 6, wherein the additional data includes at least one of root data indicating a root tone of a chord, tone color data indicating a tone color, style data indicating a style of an accompaniment, chord type data indicating a type of chord, data indicating ON/OFF of an accompaniment, and data indicating the first or second measure of a style.

8. An apparatus according to claim 6, wherein the fixed-length records are sequentially arranged to include key data and additional data every 1/n beat, wherein n is an integer, and wherein the additional data for each 1/n beat represents a different characteristic such that plural types of additional data is stored over n successive fixed-length records of one beat.

9. An apparatus according to claim 8, wherein each of the plural types of different additional data is stored in each of said n successive fixed-length records which constitute one beat and each of the plural types of additional data has an effect on n successive key data.

10. An apparatus according to claim 7, wherein said fixed-length records are sequentially arranged to include key data and a part of the additional data every 1/n beat, and the additional data is recorded over n successive fixed-length records of one beat.

11. An apparatus according to claim 10, wherein each of the parts of additional data is stored in each of said n successive fixed-length records which constitute one beat.

* * * * *